United States Patent [19]

Shinn

[11] Patent Number: 5,058,214

[45] Date of Patent: Oct. 22, 1991

[54] DRAIN TRAP APPARATUS

[76] Inventor: Dennis M. Shinn, P.O. Box 30008, Central, Ak. 99730

[21] Appl. No.: 553,186

[22] Filed: Jul. 16, 1990

[51] Int. Cl.[5] ..... E03C 1/00; E03C 1/24

[52] U.S. Cl. ..... 4/191; 4/206; 4/DIG. 7

[58] Field of Search ..... 4/191, DIG. 7, 206, 4/255, 256, 292, DIG. 14; 137/247, 247.33, 247.41, 247.51, 248; 285/127, 373, 419

[56] References Cited

U.S. PATENT DOCUMENTS

| | | | |
|---|---|---|---|
| 2,043,412 | 6/1936 | Klein | 137/247.51 |
| 4,032,455 | 6/1977 | Kale | 4/191 |
| 4,179,762 | 12/1979 | Barnhardt | 4/191 |
| 4,230,582 | 10/1980 | Tuleja | 137/247.51 |
| 4,301,554 | 11/1991 | Wojcicki | 4/206 |
| 4,429,907 | 2/1984 | Timmons | 285/373 |

FOREIGN PATENT DOCUMENTS

| | | | |
|---|---|---|---|
| 2756243 | 7/1979 | Fed. Rep. of Germany | 4/206 |

*Primary Examiner*—Henry J. Recla
*Assistant Examiner*—David J. Wolczak
*Attorney, Agent, or Firm*—Leon Gilden

[57] ABSTRACT

An apparatus including a "U" shaped drain trap, wherein the drain trap includes an upper section and a lower section, the lower section pivotally mounted to the upper section utilizing a hinge mounting the lower section to the upper section at one end thereof and a latch securing the lower section at an opposed end of the latch section relative to the hinge. The upper and lower sections include complementarily configured continuous seals to permit a fluid type securement between the upper and lower sections. The invention further includes the use of a transparent drain arrangement with a selectively securable covering mounted thereabout or alternatively utilize a "J" shaped basket of impermeable material to underlie the drain trap to accept fluid directed therefrom upon opening of the lower section relative to the upper section.

5 Claims, 5 Drawing Sheets

PRIOR ART

DRAIN TRAP APPARATUS

BACKGROUND OF THE INVENTION

1. Field of the Invention

The field of invention relates to drain trap organizations, and more particularly pertains to a new and improved drain trap apparatus permitting a readily opened lower section of a drain trap to permit access and cleaning of the drain trap structure.

2. Description of the Prior Art

The conventional drain trap utilized in plumbing is subject to blockage by various articles and debris directed therein. The trap requires a labor intensive application of energy to affect cleaning of a drain trap or in fact requires removal of the trap from associated plumbing to effect its cleaning. Prior art has been utilized to permit an accelerated cleaning of a drain trap structure but has heretofore not provided the convenience and speed of the instant invention to permit access to the drain trap component of a plumbing environment. Examples of the prior art include U.S. Pat. No. 4,301,554 to Wojcicki wherein a drain trap includes a removable tray mounted within the drain trap to permit removal of debris from the drain trap structure.

U.S. Pat. No. 4,179,762 to Barnhardt, et al. sets forth a drain trap wherein the drain trap comprises a cylindrical conduit with a forward rear end cap removable therefrom to permit access and cleaning of the drain trap structure.

U.S. Pat. No. 4,230,582 to Tuleja sets forth a drain trap structure wherein a tub shaped structure is mounted to a lowermost end of a drain trap to permit access and cleaning thereof. The Tuleja patent completely disengages the lower section relative to the upper section with associated spillage and the like therewith wherein the instant invention in its pivotal structure permits a directed pouring of fluid and debris contained within the lower section relative to the upper section.

U.S. Pat. No. 2,043,412 to Klein sets forth a drain plug wherein a stopper is removable from a drain aperture mounted at a lowermost end of a drain trap structure.

U.S. Pat. No. 4,032,455 to Kale provides a further example of a removable plug and screen member positionable within a drain trap to effect cleaning thereof.

As such, it may be appreciated that there continues to be a need for a new and improved drain trap apparatus wherein the same addresses both the problems of ease of use as well as effectiveness in construction to permit ease of cleaning of a drain trap organization and in this respect, the present invention substantially fulfills this need.

SUMMARY OF THE INVENTION

In view of the foregoing disadvantages inherent in the known types of drain trap apparatus now present in the prior art, the present invention provides a drain trap apparatus wherein the same utilizes a separably removable lower section relative to an upper section of a drain structure to permit ease of cleaning and maintenance of a drain trap structure. As such, the general purpose of the present invention, which will be described subsequently in greater detail, is to provide a new and improved drain trap apparatus which has all the advantages of the prior art drain trap apparatus and none of the disadvantages.

To attain this, the present invention provides an apparatus including a "U" shaped drain trap wherein the drain trap includes an upper section and a lower section, the lower section pivotally mounted to the upper section utilizes a hinge mounting, the lower section to the upper section at one end thereof, and a latch securing the lower section at an opposed end of the latch section relative to the hinge. The upper and lower section includes complementarily configured continuous seals to permit a fluid type securement between the upper and lower sections. The invention further includes the use of a transparent drain arrangement with a selectively securable covering mounted thereabout or alternatively utilizes a "J" shaped basket of impermeable material to underlie the drain trap to accept fluid directed therefrom upon opening of the lower section relative to the upper section.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved drain trap apparatus which has all the advantages of the prior art drain trap apparatus and none of the disadvantages.

It is another object of the present invention to provide a new and improved drain trap apparatus which may be easily and efficiently manufactured and marketed.

It is a further object of the present invention to provide a new and improved drain trap apparatus which is of a durable and reliable construction.

An even further object of the present invention is to provide a new and improved drain trap apparatus which is susceptible of a low cost of manufacture with regard to both materials and labor, and which accordingly is then susceptible of low prices of sale to the consuming public, thereby making such drain trap apparatus economically available to the buying public.

Still yet another object of the present invention is to provide a new and improved drain trap apparatus which provides in the apparatuses and methods of the prior art some of the advantages thereof, while simultaneously overcoming some of the disadvantages normally associated therewith.

Still another object of the present invention is to provide a new and improved drain trap apparatus wherein the same permits removal of a lower section relative to an upper section of a drain trap structure to enable cleaning and maintenance of the drain trap structure.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
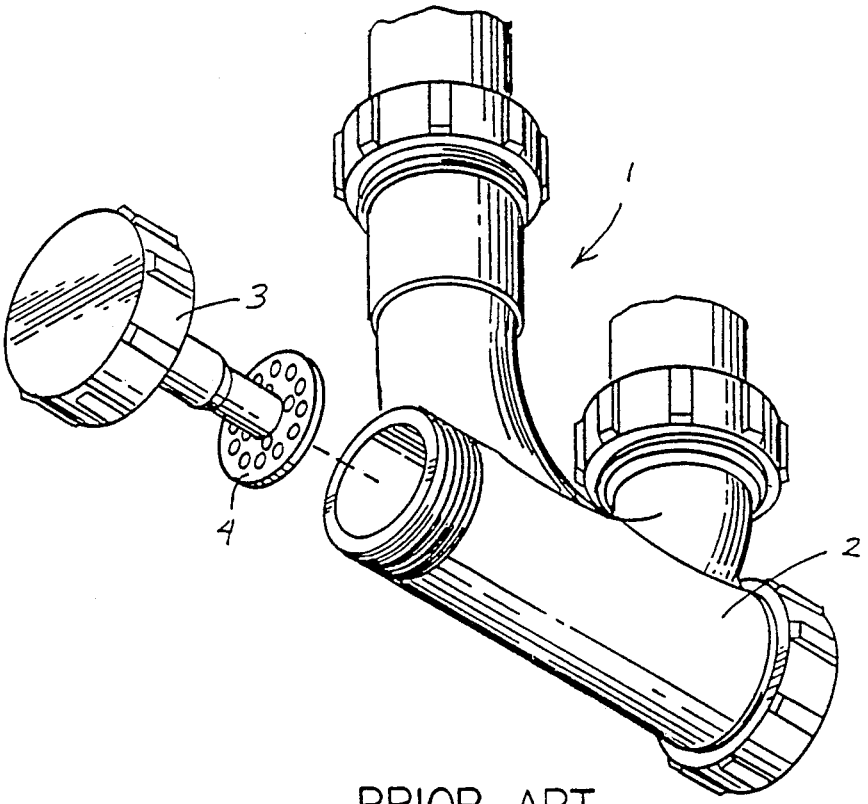
FIG. 1 is an isometric illustration of a prior art drain trap structure.

With reference now to the drawings, and in particular to FIGS. 1 to 10 thereof, a new and improved drain trap apparatus embodying the principles and concepts of the present invention and generally designated by the reference numerals 10 and 10*a* will be described.

Figure 2:
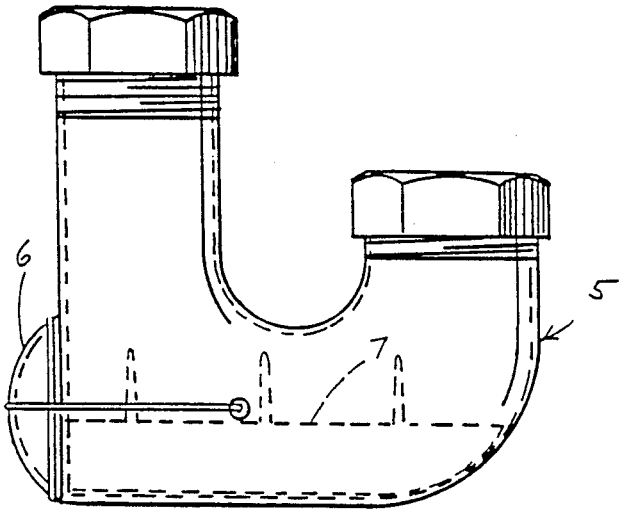
PRIOR ART FIG. 2.
FIG. 2 is an orthographic side view, taken in elevation, of a further prior art drain trap structure.
Figure 3:
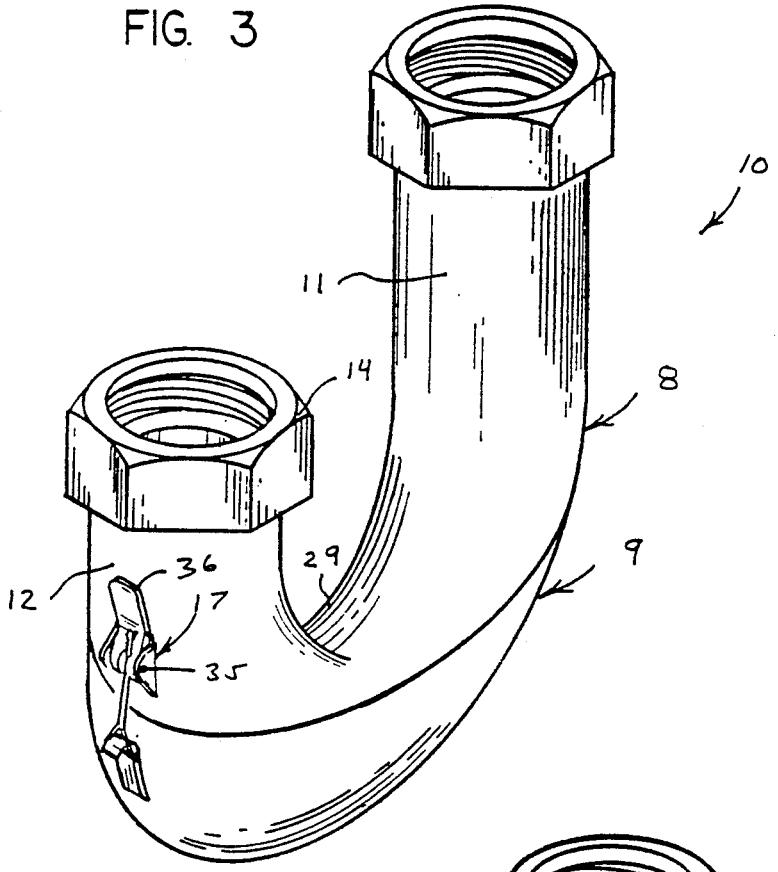
FIG. 3 is an isometric illustration of the instant invention.
Figure 4:
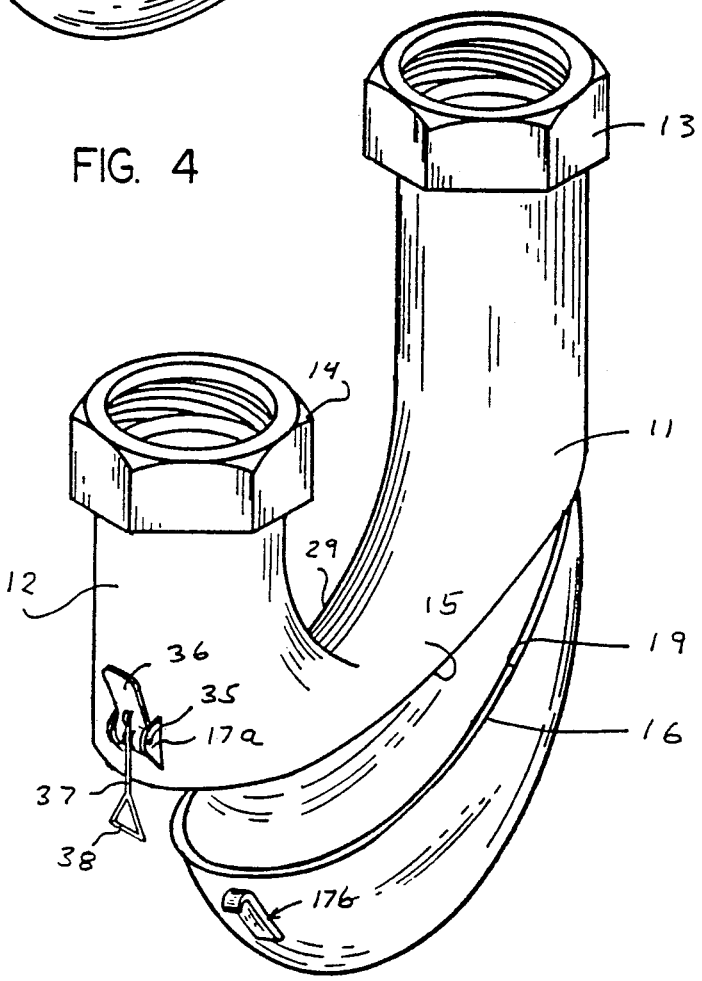
FIG. 4 is an isometric illustration of the instant invention in an open configuration.

FIG. 1 illustrated a prior art drain trap structure 1 utilizing a cylindrical conduit 2, with a removable cap 3, including a strainer 4 therewithin. The organization further utilizes a further removable cap at an opposed end of the member 2 to enhance cleaning of the drain trap structure. FIG. 2 illustrates a further prior art drain trap structure 5 wherein a cover member 6 includes a tray 7 mounted integrally thereto, and as a rule from interiorly of a drain trap to permit cleaning of the tray 7.

More specifically, the drain trap apparatus 10 of the instant invention essentially comprises a generally "U" shaped drain trap including a first pipe 11 spaced parallel to a second pipe 12, with a concave dipped section 29 defining a continuous service between the first and second pipes 11 and 12. A respective first and second coupling 13 and 14 are mounted to upper terminal ends of the first and second pipes 11 and 12 to permit securement to an associated plumbing organization. The apparatus 10 is defined by a top shaped assembly 8 selectively securable to a bottom bucket assembly 9.

Figure 5:
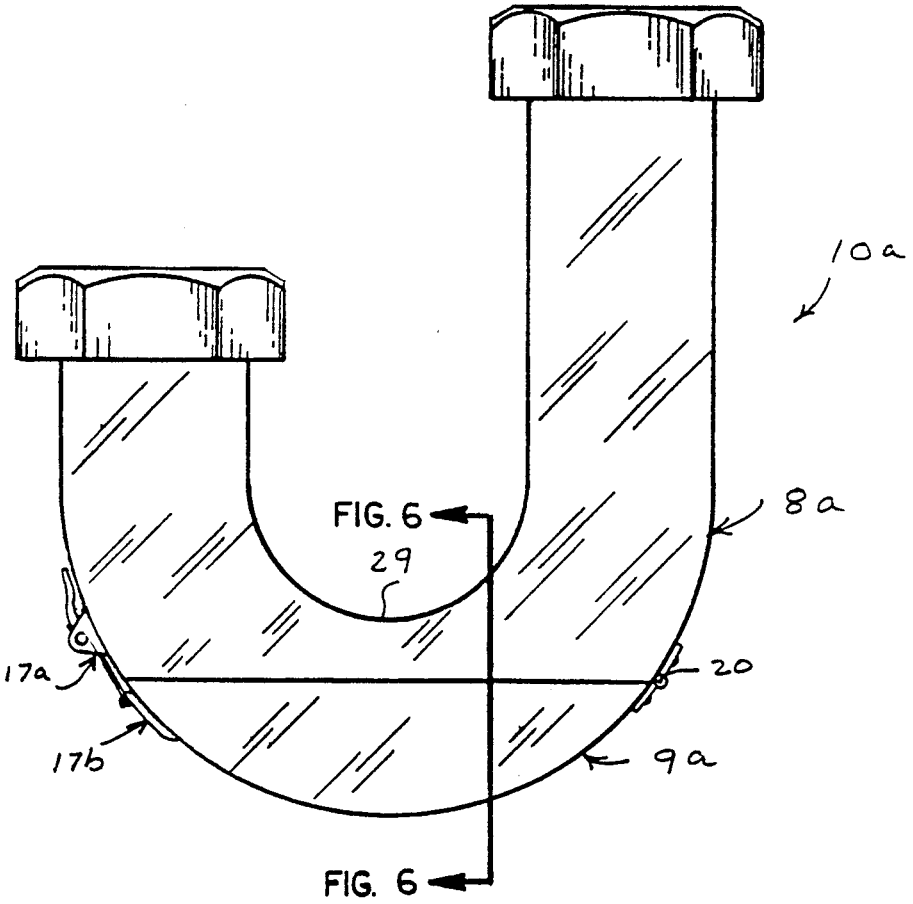
FIG. 5 is an orthographic side view of a modification of the instant invention.
Figure 6:
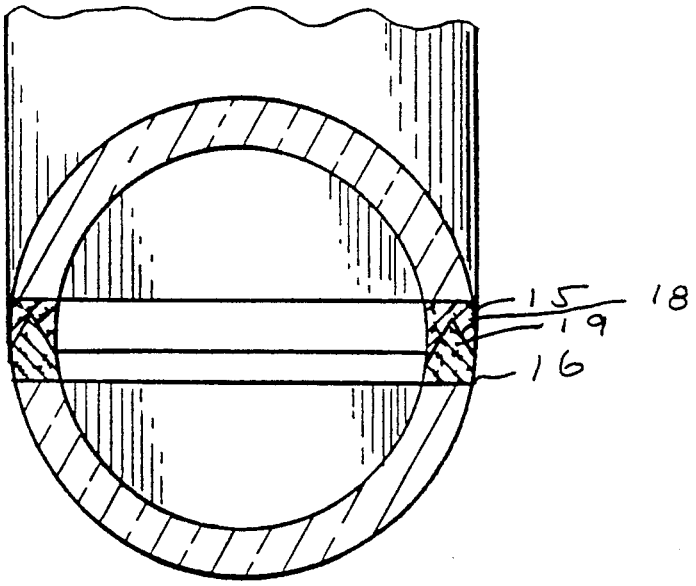
FIG. 6 is an orthographic view, taken along the lines 6—6 of FIG. 5, in the direction indicated by the arrows.
Figure 7:
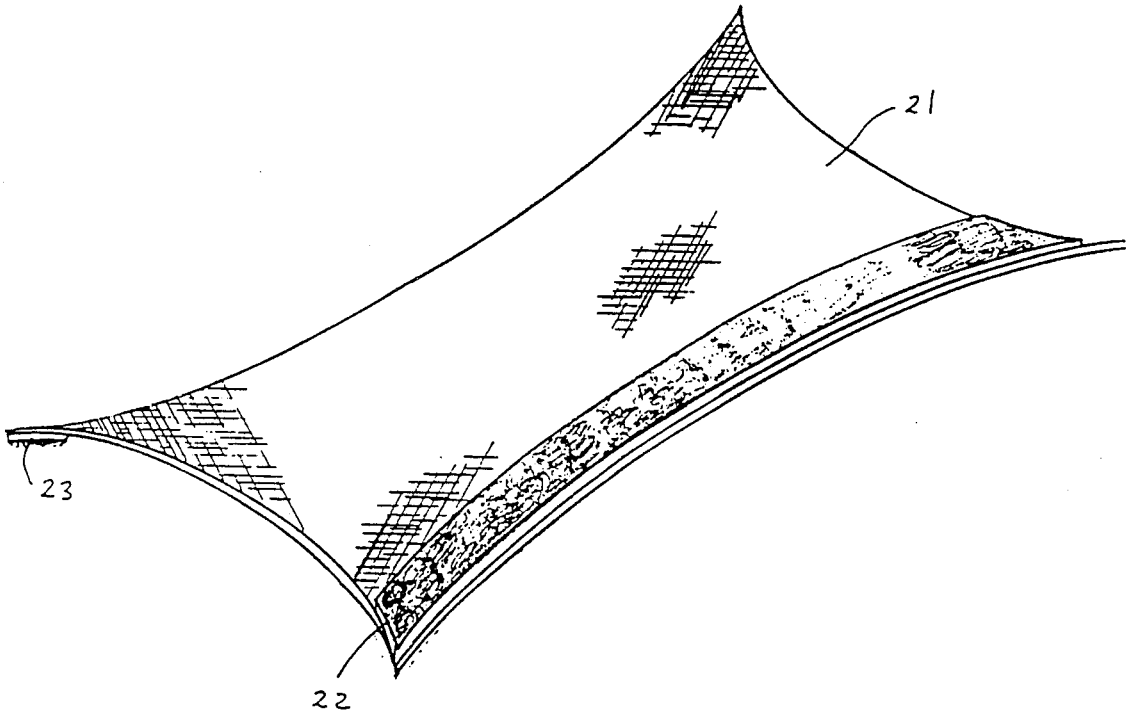
FIG. 7 is an isometric illustration of a cover utilized by the instant invention.
Figure 8:
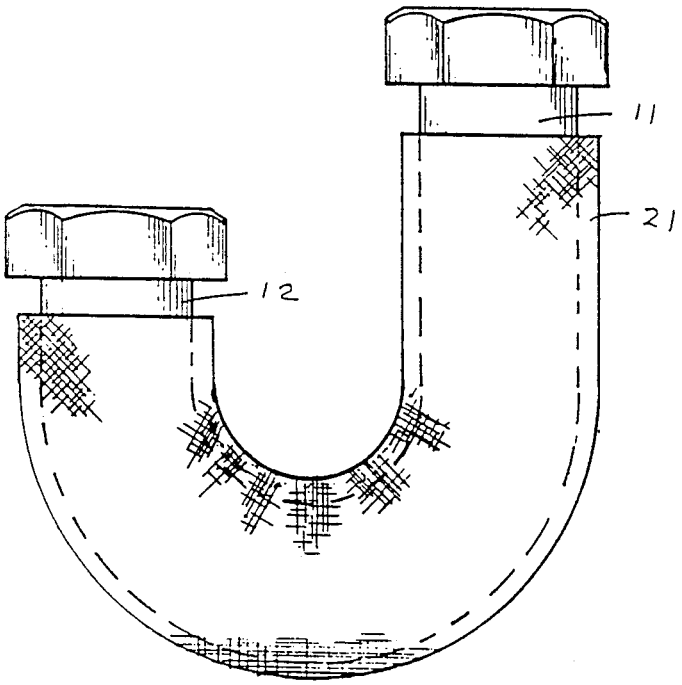
FIG. 8 is an orthographic side view, taken in elevation, of the cover as illustrated in FIG. 8 in use with a drain trap structure of the instant invention.

The top "U" shaped assembly 8 is defined at its lower terminal end by a top continuous elliptical edge 15 complementarily configured to accept a bottom continuous elliptical edge 16 defining an upper terminal end of the bottom basket assembly 9. A latch 17 is mounted to a forward end of the top and bottom assemblies 8 and 9 to overlie the edges 15 and 16, wherein the latch 17 includes a top latch member 17*a* mounted with a pivotal link to the top assembly 8 and a bottom "U" shaped latch member 17*b* defining a lower line including a projecting leg to secure the forward edge portions of the top and bottom assemblies 8 and 9 together. The latch 17*a* includes a pivot pin 35 about which a lever plate 36 is pivotally mounted at its lower end. A latch rod 37 is pivotally and medially secured to the latch plate 36 at an upper terminal end of the latch rod 37. The latch rod includes a fixed loop 38 at its lower end securable about the projecting leg of the bottom latch member 17*b* to secure and lock the top assembly 8 to the bottom assembly 9 when the latch plate is pivoted to an over-center relationship relative to the pivot pin 35, as illustrated in FIG. 5 for example. A hinge 20 is mounted to pivotally secure the top and bottom assemblies 8 and 9 together and is spaced at opposed ends of the top and bottom assemblies 8 and 9 relative to the latch 17. A top continuous seal 18 defines a "V" shaped recess to complementarily receive a "V" shaped continuous projection defined on a bottom continuous seal 19, wherein the top and bottom continuous seals 18 and 19 respectively are mounted in confronting relationship relative to one another mounted to the "V" surfaces of the top and bottom elliptical edges 15 and 16.

In this manner, upon release of the bottom latch member 17*b* by the latch member 17*a*, the bottom basket assembly 9 is pivoted downwardly relative to the top "U" shaped assembly 8 to permit cleaning and drainage of the bottom basket assembly 9 and the associated drain trap apparatus 10.

FIG. 5 illustrates a modified apparatus 10*a* wherein the "U" shaped apparatus is formed of transparent tubing to permit visual observation of debris collected therewithin. To provide a covering of the apparatus 10*a*, a fluid impermeable sheet 21 includes a first hook and loop strip 22 spaced continuously along a first edge of the sheet with a cooperative second hook and loop strip 23 mounted at an opposed continuous second edge of the sheet to permit securement of the sheet about the apparatus 10*a*.

Alternatively, a "U" shaped rigid bucket 26 formed of fluid impermeable material is defined by a generally "U" shaped cross-sectional configuration, including an opened end directed upwardly to receive the apparatus 10*a* therewithin. The bucket 26 defines a cavity to readily receive the apparatus 10*a* therewithin. The "U" shaped basket 26 includes a first apertured strap mounted to the rear terminal end of the basket 26 with a second apertured strap 28 mounted to a forward end of the basket 26. The first and second straps 27 and 28 extend upwardly relative to the basket 26 and are selectively securable to respective first and second legs 24 and 25, each of a generally "L" shaped configuration to receive one of the aligned series of apertures formed through the respective straps 27 and 28.

Figure 9:
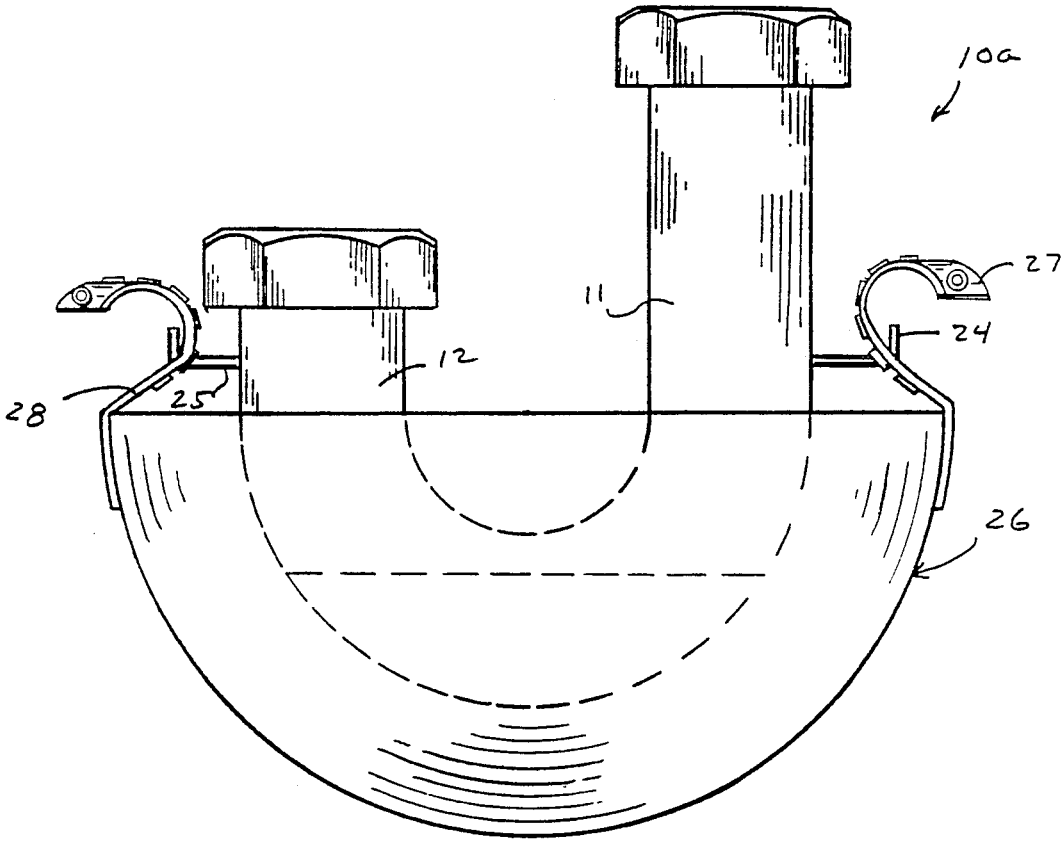
FIG. 9 is an orthographic side view, taken in elevation, of a rigid bucket member securable to the drain trap structure of the instant invention.
Figure 10:
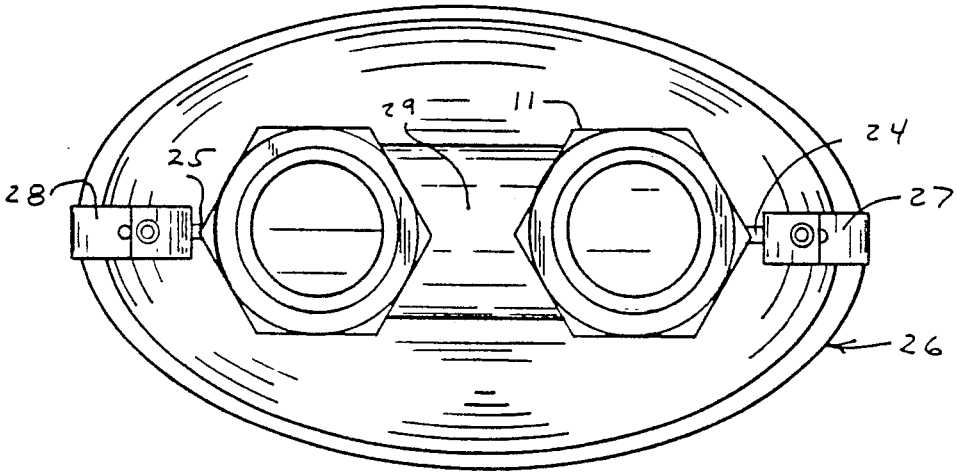
FIG. 10 is an orthographic top view of the bucket construction mounted to the drain trap structure.

As illustrated in FIG. 9, the basket 26 in a first position is mounted in contiguous association with the bucket assembly 9, wherein the "U" shaped basket 26 in a lowered second position is directed beneath the bucket assembly 9 permitting access to the latch 17 whereupon release of the latch 17, excess fluid is received within the basket 26 preventing undesirable loss of fluid to a surrounding environment.

It is understood that the use of the fluid impermeable sheet 21 as well as use of the bucket 16 of the invention is optionally utilized in conjunction with the pivotally mounted top and bottom assemblies.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A drain trap apparatus comprising, in combination, a "U" shaped conduit including first and second pipe members including a concave dip portion securing the first and second pipe members together by a continuous web defining a top assembly, the top assembly further including a continuous top edge cooperative with a bottom assembly, wherein the bottom assembly includes a bottom edge, wherein the bottom and top edges are of a complementary configuration relative to one another, and a top seal mounted to the top edge cooperative with a bottom seal mounted to the bottom edge, and wherein the top seal includes a continuous "V" shaped groove, and the bottom seal includes a continuous "V" shaped projection receivable within the "V" shaped groove, and wherein the top assembly and the bottom assembly includes a hinge securing the top assembly to the bottom assembly at a rear terminal end of the top and bottom assemblies, and a latch means for selectively securing the top assembly to the bottom assembly, wherein the latch means is positioned at an opposed end of the top and bottom assembly relative to the hinge.

2. An apparatus as set forth in claim 1 wherein the top assembly and the bottom assembly are transparent.

3. An apparatus as set forth in claim 2 further including a "U" shaped rigid fluid impermeable bucket, the fluid impermeable bucket including a first strap and a second strap, the first strap including a first series of apertures, and the second strap including a second series of apertures, and the first pipe including a first upper terminal end and the second pipe including a second upper terminal end, and a first leg mounted to the first pipe adjacent the first upper terminal end, and a second leg mounted to the second pipe adjacent the second upper terminal end, and the first and second straps selectively securable to respective first and second legs.

4. An apparatus as set forth in claim 3 wherein the "U" shaped bucket is of a generally "U" shaped cross-sectional configuration.

5. An apparatus as set forth in claim 4 wherein the latch means includes a top latch lever pivotally mounted about its lower end to the top assembly and a "U" shaped hook mounted to the bottom assembly underlying the top latch lever, and the top latch lever includes a rigid latch rod pivotally mounted medially to the top latch lever with a fixed loop formed at a lower end of the latch rod to permit securement of the "U" shaped hook by the loop and lock the top assembly to the bottom assembly when the latch rod is pivoted to a raised lock position from a lowered position with the loop secured about the "U" shaped link.

* * * * *